US006968661B2

(12) United States Patent
Kopish et al.

(10) Patent No.: US 6,968,661 B2
(45) Date of Patent: Nov. 29, 2005

(54) STIFFENER CONSTRUCTION HAVING A SNAP-ON CONNECTOR, FOR USE WITH A WALL PANEL SHELL IN A WALL SYSTEM

(75) Inventors: Andrew J. Kopish, Green Bay, WI (US); Bradley J. Bruggink, Plymouth, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/346,629

(22) Filed: Jan. 17, 2003

(65) Prior Publication Data

US 2004/0139681 A1 Jul. 22, 2004

(51) Int. Cl.[7] ..... E04B 2/30
(52) U.S. Cl. ..... 52/489.1; 52/481.1; 52/745.1
(58) Field of Search ..... 52/479, 481.1, 52/481.2, 481.3, 483.1, 489.1, 489.2, 781.3, 52/787.1, 238.1, 511, 745.1

(56) References Cited

U.S. PATENT DOCUMENTS 3,037,590 A * 6/1962 Pavlecka ..... 52/481.2
3,184,013 A * 5/1965 Pavlecka ..... 52/275
3,185,267 A * 5/1965 Pavlecka ..... 52/281
3,408,127 A 10/1968 Vincens
4,021,973 A 5/1977 Hegg et al.
4,423,573 A 1/1984 Omholt et al.
4,566,211 A 1/1986 Gustafson et al.
4,663,903 A 5/1987 Ellingson, Jr.
4,685,255 A 8/1987 Kelley
4,722,146 A 2/1988 Kemeny
5,007,473 A 4/1991 Evensen
5,038,539 A 8/1991 Kelley et al.
5,065,556 A 11/1991 DeLong et al.
5,174,086 A 12/1992 Payne et al.
5,195,287 A 3/1993 Bruggink
5,220,952 A 6/1993 Beaulieu
5,486,391 A 1/1996 Tyner
5,491,943 A 2/1996 Vondrejs et al.
5,590,502 A 1/1997 Wendt
5,644,878 A * 7/1997 Wehrmann ..... 52/287.1
5,692,345 A * 12/1997 Mogaki et al. ..... 52/483.1
5,715,638 A 2/1998 Anderson, Sr.
5,737,893 A 4/1998 Rossiter et al.
5,809,709 A 9/1998 Ryan et al.
5,875,596 A 3/1999 Muller
5,906,079 A 5/1999 Brickner et al.
6,141,926 A 11/2000 Rossiter et al.

(Continued)

*Primary Examiner*—Naoko Slack
(74) *Attorney, Agent, or Firm*—Boyle, Fredrickson, Newholm, Stein & Gratz, SC.

(57) ABSTRACT

A connection system for securing a wall panel shell to a frame member. The frame member includes a groove and the shell includes a mounting member received within the groove. The shell includes a skin member secured to one or more structural members. Each mounting member is carried by a structural member, and is part of a connector that is separate from and engaged with the structural member. The connector includes a base having spaced apart engagement areas, which are received within spaced apart recesses in the structural member. The structural member defines a flat surface which facilitates application of pressure to bond the structural member and the skin member together using an adhesive. Thereafter, the connector is engaged with the structural member via a snap-on engagement arrangement, to enable the wall panel shell to be mounted to the frame member.

29 Claims, 4 Drawing Sheets

U.S. PATENT DOCUMENTS 6,167,664 B1 1/2001 Reuter et al.
6,173,545 B1 1/2001 Feldpausch et al.
6,202,381 B1 3/2001 Dame et al.
6,295,764 B1 10/2001 Berridge et al.
6,341,457 B1 1/2002 Aerts et al.
6,446,396 B1 * 9/2002 Marangoni et al. ..... 52/36.1

* cited by examiner

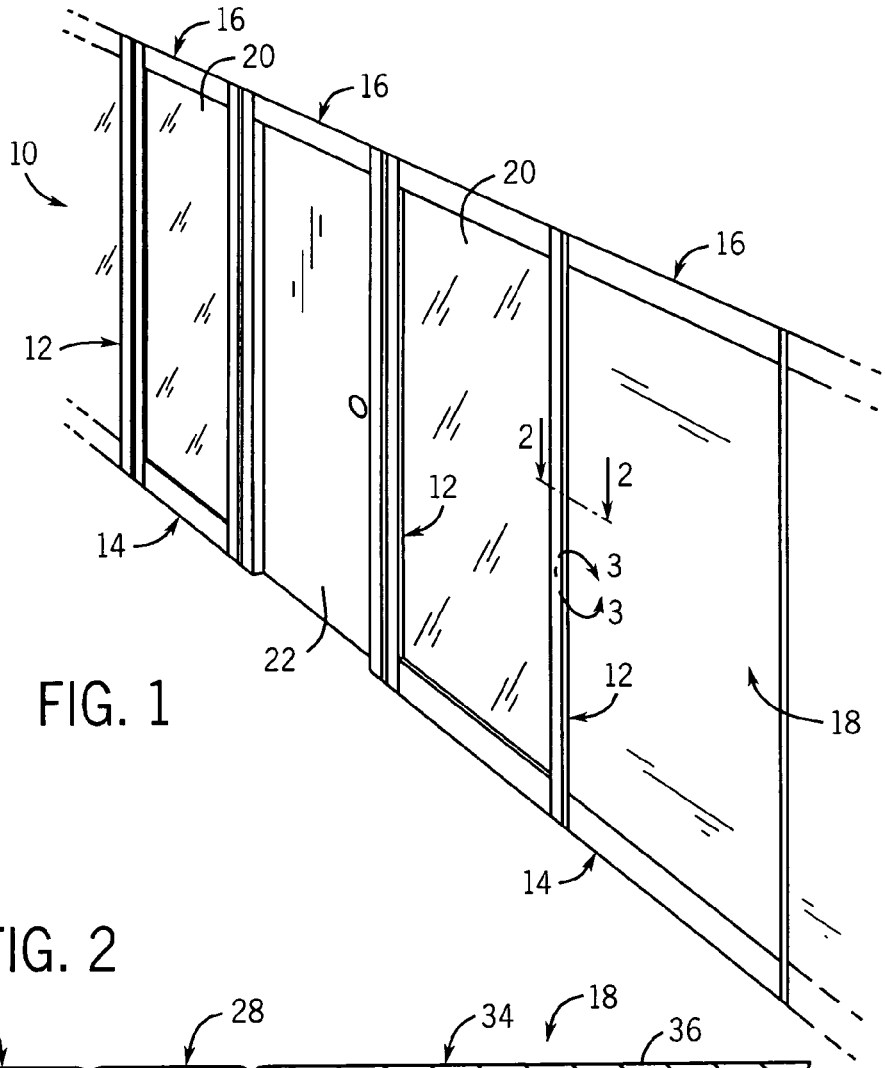
FIG. 1
FIG. 2
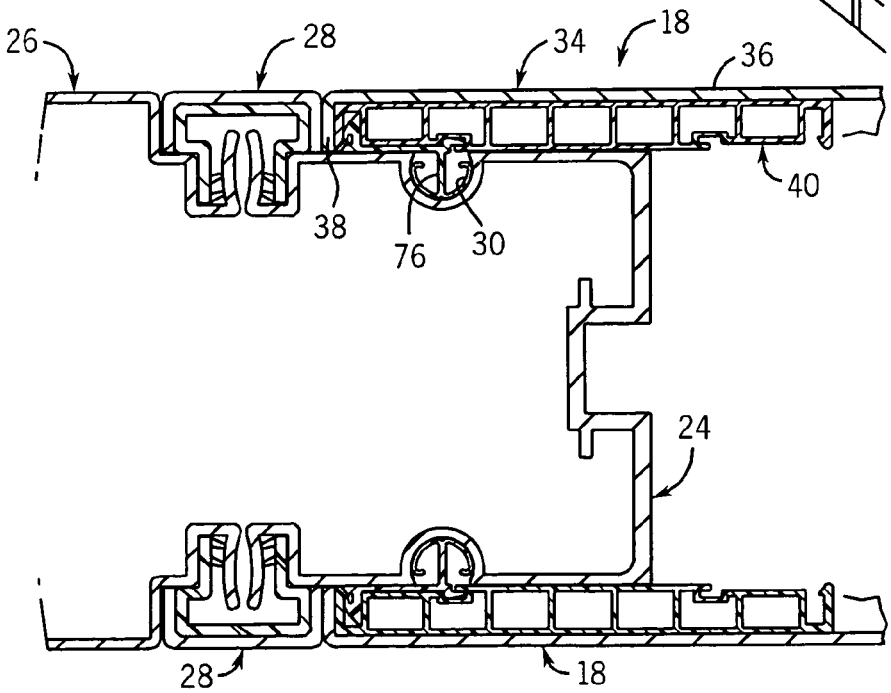

18
24
30
34
64
42
40
40
28
18
34
36

STIFFENER CONSTRUCTION HAVING A SNAP-ON CONNECTOR, FOR USE WITH A WALL PANEL SHELL IN A WALL SYSTEM

BACKGROUND AND SUMMARY OF THE INVENTION

This invention relates to a system for connecting one member to another, such as for connecting a wall panel shell to a frame in a wall system.

A wall system, such as for use in an office environment, typically has a frame constructed of a series of spaced apart vertical members connected together by horizontal members that extend between adjacent vertical members. The horizontal and vertical members typically are configured to define open areas. The wall system further includes wall panels that are adapted for engagement with the frame, to enclose the open areas defined by the frame. The wall panels are typically in the form of shells having an external skin which provides the finished appearance of the wall. The shell further includes structural stiffeners along its edges, to impart a degree of rigidity to the shell and to provide a structure for mounting the shell to the frame.

In a prior art construction, certain of the frame members include a groove and the structural member or stiffener of the shell is formed with a mounting member adapted to be received within the groove so as to enable the shell to be mounted to the frame. The prior art structural member is formed of a sheet metal material that is rolled to define a generally U-shape. One leg of the U-shaped member is secured to the inside surface of the shell, such as by use of an adhesive, and a resilient clip member is connected to the opposite leg of the structural member. The resilient clip member is engageable within the groove defined by the frame member, to mount the shell to the frame member. While this construction provides a functional means for mounting a shell to a frame in a wall system, it involves several drawbacks. First, the resilient clip is attached to the structural member in a separate operation involving an adhesive, which requires accurate placement of the resilient clip relative to the structural member as well as time to allow the adhesive to set. In addition, the resilient clip member must be accurately positioned relative to the structural member. Further, the U-shaped construction of the structural member is not conducive to the application of high pressure to the structural member, which is required in order to establish an optimal bond between the structural member to the shell using an adhesive therebetween, since the cantilevered construction of the inner leg of the structural member results in the inner leg deflecting inwardly upon application of pressure. And, the presence of the resilient clip member makes it difficult to apply pressure to the structural member by engagement with the outer leg of the structural member.

It is an object of the present invention to provide an improved arrangement for mounting one member to another, such as for mounting a wall panel shell to a frame member in a wall system. It is a further object of the invention to provide such a mounting arrangement which enables the application of high pressure to the structural member, to facilitate mounting of the structural member to a skin or the like associated with the wall panel shell. It is a further object of the invention to provide such a mounting arrangement which enables quick and easy attachment of a connector member to a structural member, in which the connector member includes a protrusion adapted for engagement within a groove associated with the frame member to enable the wall panel shell to be mounted to the frame member. A still further object of the invention is to provide such a mounting arrangement in which the components of the structural member and the connector member are formed using relatively inexpensive processes and materials, while providing a reliable, accurate and easy to assemble system for mounting a wall panel shell to a frame member of a wall system.

In accordance with the present invention, a connection arrangement for securing a first member such as a wall panel shell to a second member such as a frame member of a wall system, includes a structural member forming a part of the wall panel shell and formed with first and second recesses. The structural member includes a surface adapted to mount a skin member forming a part of the wall panel shell, such as by use of an adhesive between facing surfaces of the structural member and the skin member. A connector member, which is separate from the structural member, is adapted for engagement with the first and second recesses in the structural member. The connector member includes an outwardly extending mounting member, which is preferably in the form of a protrusion adapted to be engaged within a groove formed in the frame member.

The connector member has a first engagement area that is engaged within the first recess in the structural member, and a second engagement area that is engaged within the second recess in the structural member. The first and second engagement areas are associated with a base defined by the connector member, and the protrusion extends outwardly from the base between the first and second engagement areas. In one form, the first engagement area defines a tab that is received within the first recess, and the structural member defines a lip that overlies a portion of the first recess including the area within which the tab is received. In this manner, the first engagement area of the connector member is engaged with the structural member in a manner that prevents outward movement of the connector member.

The structural member is constructed to have a ridge that extends into the second recess. The second engagement area of the connector member includes snap-on engagement structure for engaging the second engagement area of the connector member with the ridge of the structural member. In this manner, the second engagement area of the connector member is maintained against outward movement relative to the structural member. The base of the connector member overlies a wall defines by the structural member, that is located between the first and second recesses. The second engagement area of the connector member includes an engagement wall adapted to be positioned within the second recess, and a rib that extends from the engagement wall and which is configured to provide the snap-on connection of the second engagement area with the ridge of the structural member. The engagement wall and the rib are configured such that the rib snaps over the ridge when the engagement wall is moved into the second recess.

The structural member may be formed of a thermoplastic material in an extrusion process, and is configured to define an inner surface spaced from the outer surface to which the skin is mounted. A series of ribs extend between an inner wall and an outer wall defined by the structural member, which enables the structural member to withstand pressure applied to the structural member when mounting the skin member to the structural member. The connector member is thereafter engaged with the structural member after the structural member and the skin member are secured together, such that the outwardly extending protrusion of the connector member does not interfere with the application of pressure on the structural member to secure the structural member to the skin member.

The invention contemplates a connection arrangement for securing first and second members together as described above, as well as a wall system having a shell and a frame adapted to be secured together and a method of mounting a shell to a frame of a wall system, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a partial isometric view illustrating a frame-type wall system incorporating the connection arrangement of the present invention, for securing a wall panel shell to a frame member of the wall system;

FIG. 2 is a partial section view taken along line 2—2 of FIG. 1;

DETAILED DESCRIPTION OF THE INVENTION

Figure 3:
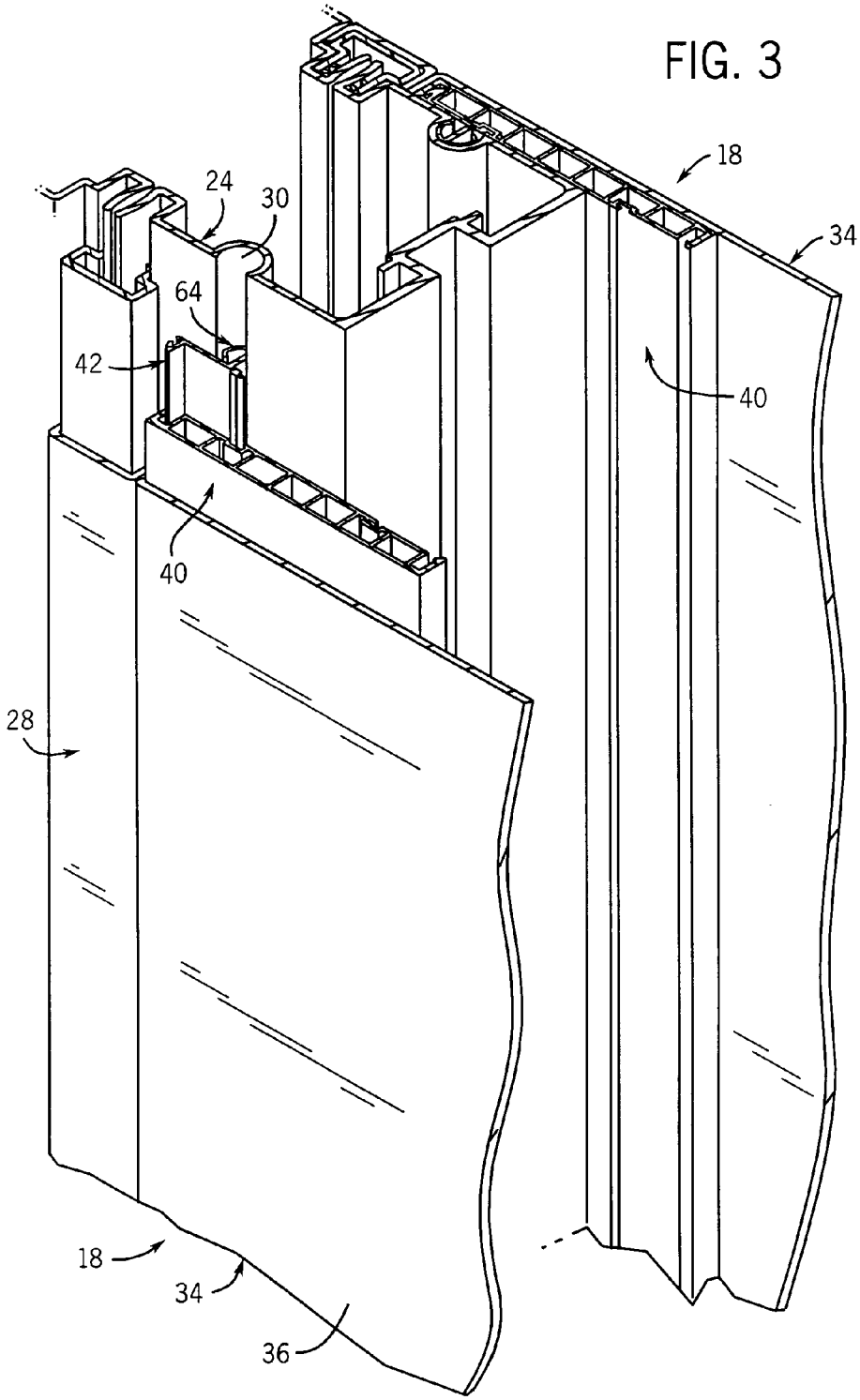
FIG. 3 is a partial isometric view, with reference to line 3—3 of FIG. 1, showing the components of the connection arrangement of the present invention.

FIG. 1 illustrates a wall system 10, which includes a frame system constructed of a series of vertical members 12 which are interconnected together via lower horizontal members 14 and upper horizontal members 16. The open areas defined by frame members 12, 14 and 16 may be enclosed by opaque and sound-absorbing wall panel shells 18, glass panels 20 or other components such as a door 22. Generally, wall system 10 may be of the type that is shown and described in PCT Patent Application No. PCT/CA01/01856 filed Dec. 21, 2001 claiming priority from Canadian Patent Application No. 2,329,591 filed Dec. 22, 2000, now U.S. Pat. No. 6,688,056, issued Feb. 10, 2004, the disclosure of which is hereby incorporated by reference. Wall system 10 has a demountable construction, which enables the various components of wall system 10 to be shipped to an installation site in knock-down form, and then assembled on site according to a predetermined wall configuration. If desired, the components of wall system 10 can subsequently be disassembled and reconfigured, to provide flexibility in dividing a space.

In wall system 10, vertical members 12 are formed by a pair of vertical sections 24, 26 that are connected together via a vertical connector 28 (FIGS. 2, 3), to form vertical member 12. The vertical sections adapted to mount wall panel shells 18, such as vertical section 24, are formed with a groove 30. The horizontal members, such as 14, 16, have similar grooves for mounting wall panel shells 18.

The particular details of construction of vertical members 12, including vertical sections 24, 26, may take any desired form.

Figure 4:
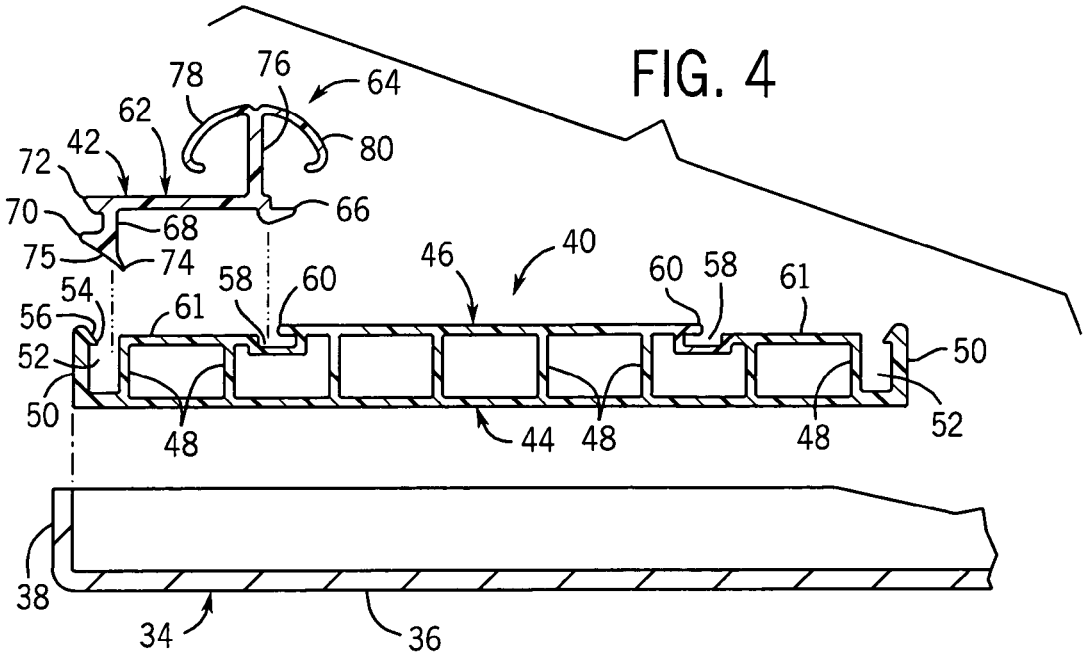
FIG. 4 is an exploded view of the wall panel shell components shown assembled together in FIG. 2 for mounting to a frame member of the wall system.
Figure 5:
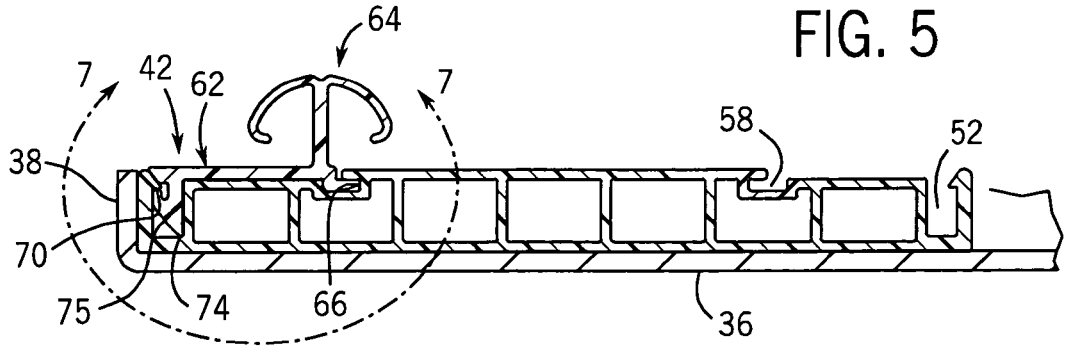
FIG. 5 is a view similar to FIG. 4, showing the wall panel shell components assembled together.

Referring to FIGS. 2 and 3, each wall panel shell 18 includes a skin 34 having an outer wall 36 and a series of side walls 38. Typically, wall panel shell 34 is constructed of a bent sheet metal material. The configuration of skin 34 requires outer wall 36 to have a large service area sufficient to cover the open areas defined by frame members 12, 14 and 16, which means that skin 36 has very little rigidity. For this reason, wall panel shell 18 has a series of structural members or stiffeners 40 mounted about its periphery. Structural members 40 are configured to extend throughout the length and width of skin 34, to impart rigidity and stiffness to wall panel shell 18. As shown in FIG. 4, a connector member 42 is engaged with the rearwardly facing surface of each structural member 40, and is configured to enable structural member 40 to be engaged with vertical section 24, in a manner to be explained.

Structural member 40 defines an outer wall 44 and an inner wall 46, which are joined together by a series of ribs 48. Outer wall 44 defines a flat outer surface which is adapted for engagement with the inner surface of skin outer wall 36. The depth of structural member 40 is generally equal to the depth of skin member 34. Structural member 40 further includes a pair of side walls 50, each of which is located outwardly of an adjacent one of ribs 48. Each side wall 50 and the adjacent rib 48 define an outer recess 52. The inner end of each side wall 50 defines a ridge 54 and a ramped surface 56 located outwardly of and leading to ridge 54. In addition, inner wall 46 of structural member 40 defines a pair of inner recesses 58. Inner wall 46 is formed to define a lip 60 that overlies the inner area of each inner recess 58. The area of inner wall 46 located between each outer recess 52 and inner recess 58, shown at 61, is slightly recessed relative to the central area of inner wall 46 located between inner recesses 58.

In a preferred form, structural member 40 is formed of a thermoplastic material such as polyvinyl chloride (PVC) in an extrusion process. It is understood, however, that any other satisfactory type of material and forming method may be employed to form structural member 40.

Connector member 42 includes a generally planar base 62 and a mounting member 64 that extends outwardly from base 62. Inner and outer engagement areas are defined by base 62, for enabling connector member 42 to be engaged with structural member 40.

The inner engagement area of base 62 is defined by an offset tab 66 which forms the inner edge of connector member 42, and which is configured to be received within one of inner recesses 58 defined by structural member 40. The outer engagement area of base 62 is defined by an engagement wall 68 that extends inwardly from base 62 adjacent the outer end of base 62. An engagement rib 70 extends outwardly from engagement wall 68, and is spaced from an end area 72 defined by base 62. Engagement wall 68 terminates in an inwardly extending pointed edge 74. A beveled surface 75 extends between engagement rib 70 and pointed edge 74.

Mounting member 64 extends from base 62 in a direction opposite that of engagement wall 68, and includes a stem 76 and end arcuate outer wall sections 78, 80 that extend in opposite directions from the outer end of stem 76.

In a representative construction, connector member 42 is formed in an extrusion process, such that the various components of connector member 42 are formed together continuously throughout the length of connector member 42. Connector member 42 is preferably formed of a rigid PVC material in an extrusion process, although it is understood that other materials may be employed. This construction of connector member 42 provides a relatively low cost and accurate positioning of the components of connector member 42 relative to each other. It is understood, however, that other types of forming and assembly methods may be employed, in a manner known to those skilled in the art.

Structural member 40 and connector member 42 are formed and configured in a manner that facilitates mounting of connector member 42 to structural member 40 after structural member 40 and skin member 34 are secured together. Representatively, an adhesive is placed between the outer surface of structural member outer wall 44 and the facing inner surface of skin member outer wall 36. Pressure is then applied to skin member 34 and structural member 40 to enable the adhesive to set and provide a secure bond between structural member 40 and skin member 34. Representatively, structural member 40 and skin member 34 may be passed through a nip roll arrangement, whereby pressure is applied to the outer surface of skin member outer wall 36 and to inner wall 46 of structural member 40.

Figure 6:
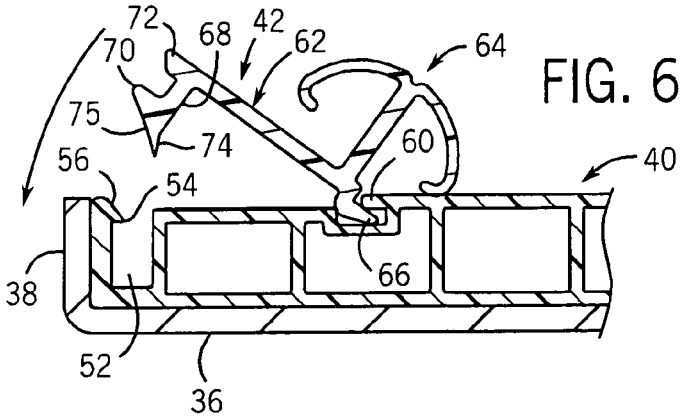
FIG. 6 is a partial section view of an end portion of the wall panel shell of FIG. 5, showing initial engagement of the connector member with the structural member.
Figure 7:
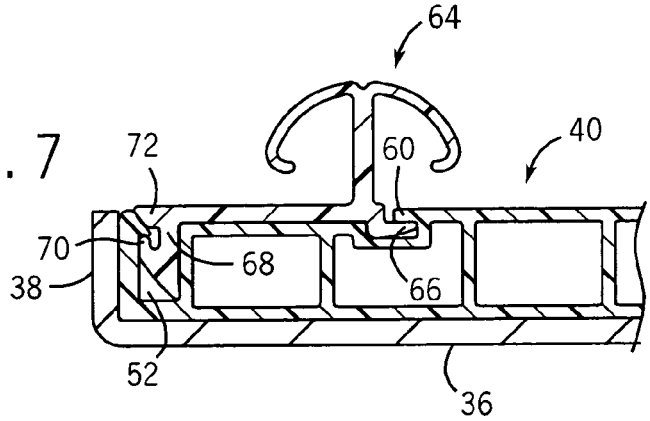
FIG. 7 is a view similar to FIG. 6, with reference to line 7—7 of FIG. 5, showing the connector member mounted to the structural member.

After engagement of skin member 34 and structural member 40, connector member 42 is mounted to structural member 40. Connector member 42 is engaged with structural member 40 by first positioning tab 66, defined at the inner end of base 62, within inner recess 58, as shown in FIG. 6. Lip 60 overlies tab 66 when tab 66 is engaged within inner recess 58, to prevent outward movement of the inner end of base 62. The outer end of base 62 is then rotated toward structural member 40 in the direction of the arrow shown in FIG. 6, such that engagement wall 68 is inserted into outer recess 52. Connector member 42 is first positioned such that tab 66 is engaged within inner recess 58 below lip 60, and is then initially rotated to a position in which pointed edge 74 is received within recess 52. During such movement of connector member 42, pointed edge 74 is moved between ramped surface 56 and the side surface of outer recess 52 defined by rib 48. Pointed edge 74 engages the outer surface of rib 48 to provide initial frictional engagement of connector member 42 with structural member 40, to maintain the outer end of engagement wall 68 within recess 52. After such initial engagement of connector member 42 with structural member 40 throughout the length of connector member 42, connector member 42 is moved to its fully engaged position of FIG. 7 by applying an outward force to the outer end of connector member 42, tending to advance engagement wall 68 into recess 52. During such movement of connector member 42, engagement rib 70 comes into contact with ramped surface 56, which causes engagement rib 70 to deflect until the end of engagement rib 70 passes ridge 54. Thereafter, engagement rib 70 returns to its undeformed condition as shown in FIG. 7, to engage the end of engagement rib 70 with the underside of ridge 54. This provides a snap-on engagement of the outer area of connector member 42 with structural member 40. End area 72 of base 62 has an angled surface that is complementary to the angle of ramped surface 56, and engages ramped surface 56 when connector member 42 is in its fully engaged position as shown in FIG. 7. The inner wall area 61 between outer recess 52 and inner recess 58 is offset from the central area of inner wall 46 in an amount generally equal to the thickness of connector member base 62, such that connector member base 62 and the central area of inner wall 46 are generally coplanar and flush when connector member 42 is engaged with structural member 40.

Figure 8:
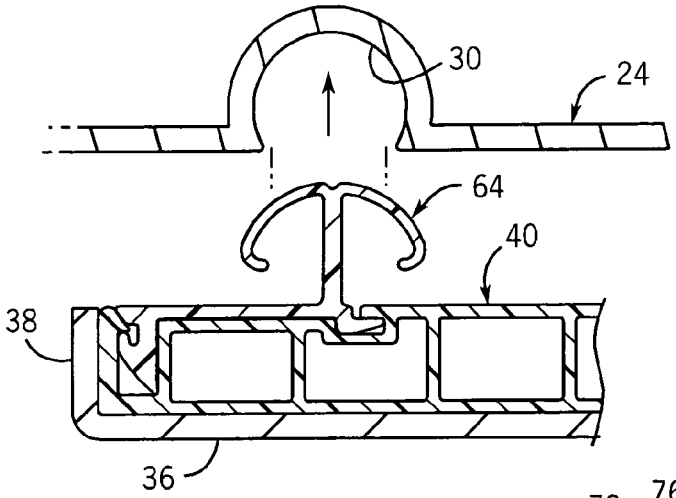
FIG. 8 is an enlarged partial section view similar to FIG. 7, showing a frame member of the wall system to which the wall panel shell is adapted to be secured.
Figure 9:
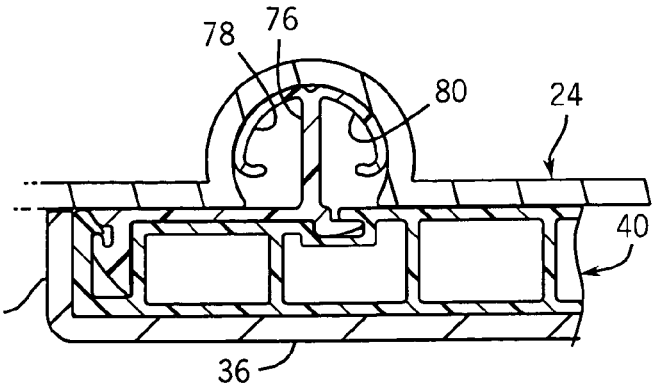
FIG. 9 is a view similar to FIGS. 7 and 8, showing engagement of the wall panel shell with the frame member.

After engagement of connector member 42 with structural member 40 in this manner, wall panel shell 18 can be secured to a frame member of wall system 10, such as vertical section 24, by engaging mounting member 64 within groove 30 as shown in FIGS. 8 and 9. Advancement of mounting member 64 toward groove 30 causes arcuate outer wall sections 78, 80 to engage the edges of groove 30, and to deflect inwardly toward each other as base 62 is moved into contact with the surface of vertical section 24 within which groove 30 is formed. Groove 30 has an arcuate inner surface that extends greater than 180°, to provide secure engagement of mounting member 64 within groove 30. The resiliency of outer wall sections 78, 80 provides frictional engagement with the surface of groove 30, and also enables mounting member 64 to be withdrawn from groove 30 upon application of an outward force in the event wall panel shell 18 is to be removed from engagement with vertical section 24.

Depending upon the orientation of structural member 40, connector member 42 is engaged with one or the other of the sets of recesses 52, 58. That is, the symmetrical construction of structural member 40 enables connector member 40 to be positioned such that either side of connector member 40 may be placed adjacent side wall 38 of skin member 34. The mirror image configuration of recesses 52, 58 enables a connector member 42 to be engaged with the structural member 40 regardless of the orientation of the structural member 40.

While the invention has been shown and described with respect to a specific embodiment, various alternatives and modifications are possible and contemplated as being within the scope of the present invention. For example, and without limitation, while the connector member has been shown and described as being engageable with the structural member using a pair of spaced apart recesses, it is also contemplated that a single recess may be utilized, with appropriately configured engagement structure on the connector member, for securing the connector member to the structural member. More than two recesses could also be employed. In addition, while the engagement areas of the connector member are shown and described as providing engagement of the connector member with the structural member in a pivoting-type manner, it is also contemplated that the recesses in the structural member and the engagement areas of the connector member may be configured to provide straightforward push-on engagement of the connector member with the structural member. Also, it is understood that the configuration of the mounting member carried by the connector member may vary from the configuration as shown and described, and that any other type of mating groove and mounting member configuration may be employed. The connector member may extend the entire length of the structural member, or connector members may be positioned at spaced locations along the length of the structural member.

Various alternatives and embodiments are contemplated as being within the scope of the following claims particularly pointing out and distinctly claiming the subject matter regarded as the invention.

We claim:

1. A wall system, comprising:

a frame arrangement comprising a series of frame members defining one or more open areas;

a shell configured to enclose at least one of the open areas, wherein the shell includes an outer skin and at least one structural member to which the skin is secured; and wherein the frame arrangement includes a groove and wherein the structural member of the shell includes a connector member formed separately from the structural member and engaged with the structural member, wherein the connector member is carried by the structural member, and wherein the connector member includes a resilient arcuate projection configured to engage the groove by application of a push-on force to the structural member that advances the projection of the connector member toward the frame arrangement and into the groove, wherein the groove includes an arcuate wall that matches the arcuate projection, wherein the groove is shaped such that the resilient arcuate projection deforms upon entry into the groove to engage the resilient arcuate projection within the groove and to mount the shell to the frame arrangement.

2. The wall system of claim 1, wherein the connector member includes a base, wherein the base includes engagement structure for engaging the connector member with the structural member, and wherein the projection is engaged with and extends from the base.

3. The wall system of claim 2, wherein the structural member defines a pair of recesses, wherein the connector member base includes a first engagement member engaged within a first one of the recesses and a second engagement member engaged within a second one of the recesses.

4. The wall system of claim 1, wherein the connector member includes a base, wherein the base includes engagement structure for engaging the connector member with the structural member, and wherein the projection is engaged with and extends from the base.

5. The wall system of claim 4, wherein the structural member defines a pair of recesses, wherein the connector member base includes a first engagement member engaged within a first one of the recesses and a second engagement member engaged within a second one of the recesses.

6. A wall system, comprising:

a frame arrangement comprising a series of frame members defining one or more open areas;

a shell configured to enclose at least one of the open areas, wherein the shell includes an outer skin and at least one structural member to which the skin is secured;

wherein the frame arrangement includes a groove and wherein the structural member of the shell includes a connector member formed separately from the structural member and engaged with the structural member, wherein the connector member includes a projection adapted for engagement within the groove; and wherein the connector member includes a base, wherein the base includes engagement structure for engaging the connector member with the structural member, and wherein the projection is engaged with and extends from the base; and wherein the projection comprises an arcuate member and wherein the groove defines an arcuate cross section, wherein the arcuate member is configured to be received within the arcuate groove; and wherein the arcuate member is formed of a resilient material, wherein the arcuate member is deflectable upon insertion into the groove so as to provide releasable engagement of the arcuate member within the groove.

7. The wall system of claim 6, wherein the projection further includes a stem that extends from the base of the connector member, wherein the arcuate member is carried by the stem.

8. The wall system of claim 7, wherein the stem, the base and the arcuate member are formed together.

9. A wall system, comprising:

a frame arrangement comprising a series of frame members defining one or more open areas;

a shell configured to enclose at least one of the open areas, wherein the shell includes an outer skin and at least one structural member to which the skin is secured; and wherein the frame arrangement includes a groove and wherein the structural member of the shell includes a connector member formed separately from the structural member and engaged with the structural member, wherein the connector member includes a projection adapted for engagement within the groove; and wherein the connector member includes a base, wherein the base includes engagement structure for engaging the connector member with the structural member, and wherein the projection is engaged with and extends from the base; and wherein the structural member defines a pair of recesses, wherein the connector member base includes a first engagement member engaged within a first one of the recesses and a second engagement member engaged within a second one of the recesses; and wherein the projection extends outwardly from the base at a location between the first and second engagement members.

10. The wall system of claim 8, wherein the first recess in the structural member includes an overlying lip, and wherein the first engagement member of the base includes a tab configured to underlie the lip.

11. The wall system of claim 10, wherein the second engagement member is configured for engagement with the second recess subsequent to placement of the tab under the lip of the first recess, wherein the second engagement member is engageable within the second recess by means of a snap-on connection arrangement.

12. The wall system of claim 11, wherein the snap-on connection arrangement comprises a ridge overlying at least a portion of the second recess, and a rib associated with the second engagement member which engages the ridge in a snap-on manner upon movement of the second engagement member into the second recess.

13. The wall system of claim 12, wherein the base includes an end configured to engage the ridge and wherein the rib is spaced from the end of the base, wherein the ridge is received within a space between the rib and the end of the base.

14. The wall system of claim 13, further comprising an engagement edge associated with the second engagement member, wherein the engagement edge is configured for engagement within the second recess to provide initial engagement of the second engagement member within the second recess.

15. The wall system of claim 14, wherein the second engagement member comprises a wall that extends from the base member and is adapted to be received within the second recess, wherein the rib extends from the wall toward an inner area defined by the wall, and wherein the engagement edge extends from the wall at a location outwardly of the inner area of the wall.

16. A method of connecting a shell to a frame of a wall system, wherein the frame defines a shell mounting groove, and wherein the shell includes a skin member and a structural member to which the skin member is connected, comprising the steps of:

providing a connector member separate from the structural member, wherein the connector member includes a resilient arcuate mounting member;

first engaging the connector member with the structural member, wherein the structural member and the connector member are engaged such that the connector member is carried by the structural member, and wherein the connector member is configured such that the mounting member extends from the structural member; and subsequently mounting the shell to the frame of the wall system by engaging the resilient arcuate mounting member within the shell mounting groove defined by the frame, wherein the shell mounting groove defined by the frame has an arcuate cross section that matches the arcuate mounting member, wherein the groove is shaped such that the resilient arcuate mounting member deforms upon entry into the groove to engage the arcuate mounting member with the groove and to mount the shell to the frame.

17. A method of connecting a shell to a frame of a wall system, wherein the frame defines a shell mounting groove, and wherein the shell includes a skin member and a structural member to which the skin member is connected, comprising the steps of:

providing a connector member separate from the structural member, wherein the connector member includes a mounting member;

engaging the connector member with the structural member, wherein the connector member is configured such that the mounting member extends from the structural member, wherein the step of engaging the connector member with the structural member is carried out by first engaging a first edge defined by a base associated with the connector member within a first recess defined by the structural member in a manner that prevents outward movement of the first edge relative to the structural member and, after engagement of the first edge within the first recess, engaging a second edge defined by the base within a second recess defined by the structural member in a manner that prevents outward movement of the second edge relative to the structural member, wherein the connector member is carried by the structural member; and mounting the shell to the frame of the wall system after engagement of the connector member with the structural member, by engaging the mounting member within the shell mounting groove defined by the frame.

18. The method of claim 17, wherein the step of engaging the first edge within the first recess is carried out by placing a tab portion defined by the first edge into an area of the first recess over which a lip is located, wherein engagement of the tab with the lip prevents outward movement of the first edge of the base.

19. The method of claim 17, wherein the step of engaging the second edge of the base within the second recess is carried out by placing an inwardly extending engagement wall into the second recess, and engaging a rib extending from the engagement wall with a ridge defined by the structural member.

20. The method of claim 17, wherein the step of mounting the shell to the frame of the wall system after engagement of the connector member with the structural member is carried out by application of a push-on force to the structural member that advances the mounting member of the connector member toward the frame and into the groove.

21. A method of connecting a shell to a frame of a wall system, wherein the frame defines a shell mounting groove, and wherein the shell includes a skin member and a structural member to which the skin member is connected, comprising the steps of:

providing a connector member separate from the structural member, wherein the connector member includes a mounting member;

engaging the connector member with the structural member, wherein the connector member is configured such that the mounting member extends from the structural member, wherein the step of engaging the connector member with the structural member is carried out by engaging a first edge defined by a base associated with the connector member within a first recess defined by the structural member in a manner that prevents outward movement of the first edge relative to the structural member, and subsequently engaging a second edge defined by the base within a second recess defined by the structural member in a manner that prevents outward movement of the second edge relative to the structural member; and mounting the shell to the frame of the wall system by engaging the mounting member within the shell mounting groove defined by the frame;

wherein the structural member is formed with a pair of first recesses and a pair of second recesses, and wherein the step of engaging the connector member with the structural member is carried out by engaging the connector member with one of the first recesses and with one of the second recesses, wherein one of the first and second recesses is configured to provide engagement of the connector member with the groove when the structural member is located in a first position on the shell, and wherein another of the first and second recesses is configured so as to provide engagement of the connector member with the groove when the structural member is positioned in a second location relative to the shell.

22. A connection arrangement for a wall system, for securing a structural member associated with a shell to a frame member, wherein the frame member includes a recess, comprising:

first and second recesses associated with the structural member; and a connector member separate from the structural member, wherein the connector member includes first and second engagement areas configured for engagement with the first and second recesses, respectively, to mount the connector member to the structural member, wherein the connector member is carried by the structural member, and wherein the connector member includes an outwardly extending mounting member configured for engagement within the recess in the frame member to secure the structural member to the frame member, wherein the frame member includes a groove and wherein the mounting member includes a resilient arcuate projection configured to engage the groove, by application of a push-on force to the structural member that advances the projection of the connector member toward the frame member and into the groove, wherein the groove includes an arcuate wall that matches the arcuate projection, wherein the groove is shaped such that the resilient arcuate projection deforms upon entry into the groove to engage the resilient arcuate projection within the groove and to mount the shell to the frame member.

23. A connection arrangement for a wall system, for securing a structural member associated with a shell to a frame member, wherein the frame member includes a recess, comprising:

first and second recesses associated with the structural member; and a connector member separate from the structural member, wherein the connector member includes first and second engagement areas configured for engagement with the first and second recesses, respectively, to mount the connector member to the structural member, and wherein the connector member includes an outwardly extending mounting member configured for engagement within the recess in the frame member to secure the structural member to the frame member, wherein the outwardly extending mounting member is located between the first and second engagement areas of the connector member.

24. The connection arrangement of claim 23, wherein the first recess includes a lip and wherein the first engagement area of the connector member defines a tab configured to underlie the lip so as to prevent outward movement of the first engagement area relative to the structural member.

25. The connection arrangement of claim 24, wherein the connector member is configured such that the second engagement area is engaged within the second recess after the tab is engaged within the first recess under the lip, and wherein the second engagement area includes snap-on connector structure for engaging a ridge associated with the second recess.

26. A method of connecting a shell to a frame of a wall system, wherein the frame defines a shell mounting groove, and wherein the shell includes a skin member and a structural member to which the skin member is connected, comprising the steps of:

providing a connector member separate from the structural member, wherein the connector member includes a mounting member;

first engaging the connector member with the structural member, wherein the structural member and the connector member are engaged such that the connector member is carried by the structural member, and wherein the connector member is configured such that the mounting member extends from the structural member; and subsequently mounting the shell to the frame of the wall system by engaging the mounting member within the shell mounting groove defined by the frame;

wherein the step of engaging the connector member with the structural member is carried out by engaging a first edge defined by a base associated with the connector member within a first recess defined by the structural member in a manner that prevents outward movement of the first edge relative to the structural member, and subsequently engaging a second edge defined by the base within a second recess defined by the structural member in a manner that prevents outward movement of the second edge relative to the structural member.

27. The method of claim 26, wherein the step of engaging the first edge within the first recess is carried out by placing a tab portion defined by the first edge into an area of the first recess over which a lip is located, wherein engagement of the tab with the lip prevents outward movement of the first edge of the base.

28. The method of claim 26, wherein the step of engaging the second edge of the base within the second recess is carried out by placing an inwardly extending engagement wall into the second recess, and engaging a rib extending from the engagement wall with a ridge defined by the structural member.

29. The method of claim 26, wherein the structural member is formed with a pair of first recesses and a pair of second recesses, and wherein the step of engaging the connector member with the structural member is carried out by engaging the connector member with one of the first recesses and with one of the second recesses, wherein one of the first and second recesses is configured to provide engagement of the connector member with the groove when the structural member is located in a first position on the shell, and wherein another set of the first and second recesses is configured so as to provide engagement of the connector member with the groove when the structural member is positioned in a second location relative to the shell.

* * * * *

UNITED STATES PATENT AND TRADEMARK OFFICE

CERTIFICATE OF CORRECTION

PATENT NO. : 6,968,661 B2
DATED : November 29, 2005
INVENTOR(S) : Andrew J. Kopish et al.

It is certified that error appears in the above-identified patent and that said Letters Patent is hereby corrected as shown below:

Column 8,
Line 35, delete “8” and substitute -- 9 --;

Column 10,
Line 67, after “groove” delete “,”.

Signed and Sealed this

Seventh Day of February, 2006

JON W. DUDAS
*Director of the United States Patent and Trademark Office*